United States Patent [19]

Wilkins

[11] Patent Number: 4,855,568

[45] Date of Patent: Aug. 8, 1989

[54] WALLPAPER STEAMER

[75] Inventor: Peter R. Wilkins, Blackwell, England

[73] Assignee: Black & Decker Inc., Newark, Del.

[21] Appl. No.: 123,082

[22] Filed: Nov. 19, 1987

[30] Foreign Application Priority Data

Nov. 20, 1986 [GB] United Kingdom ..... 8627734

[51] Int. Cl.[4] ..... F22B 1/28

[52] U.S. Cl. ..... 219/271; 219/273

[58] Field of Search ..... 219/271, 273, 274, 275, 219/276

[56] References Cited

U.S. PATENT DOCUMENTS

| | | | |
|---|---|---|---|
| D. 287,892 | 1/1987 | Rosa et al. | D32/17 |
| D. 294,417 | 2/1988 | Schmitz | D32/70 |
| D. 667,706 | 10/1982 | Karaki | D7/5 |
| 1,391,350 | 9/1921 | Tucker . | |
| 2,137,876 | 11/1938 | Hudson | 219/271 |
| 2,254,495 | 9/1941 | Randolph et al. . | |
| 3,258,578 | 6/1966 | Ferris | 219/275 |
| 3,465,469 | 9/1969 | Winter et al. . | |
| 3,496,668 | 2/1970 | Slater | 219/275 |
| 3,620,055 | 11/1971 | Blachly | 219/275 |
| 3,690,024 | 9/1972 | Osrow . | |
| 3,781,519 | 12/1973 | Martin et al. | 219/273 |
| 3,805,425 | 4/1974 | Spoida et al. | 38/69 |
| 3,949,499 | 4/1976 | Schaeffer et al. | 38/77.3 |
| 4,143,998 | 3/1979 | O'Connor . | |
| 4,532,411 | 7/1985 | Terraillon et al. | 219/245 |
| 4,616,122 | 10/1986 | Burian et al. | 219/273 |
| 4,646,451 | 3/1987 | Nakao et al. | 38/77.3 |

FOREIGN PATENT DOCUMENTS

| | | |
|---|---|---|
| 0159134 | 10/1985 | European Pat. Off. . |
| 2159397A | 12/1985 | United Kingdom . |

*Primary Examiner*—Teresa J. Walberg

*Attorney, Agent, or Firm*—Edward D. Murphy; Dennis Dearing; Edward D. C. Bartlett

[57] ABSTRACT

A hand-held wallpaper steamer for use in wallpaper stripping having a housing of two-part clam shell construction, a base portion with a floor and a peripheral wall to form a chamber open at one face. The clam shells are contoured to receive the base portion at the open end of the housing to close that end. The clam shells are shaped to form a handle spaced from the base portion and extending in a direction generally parallel to the base portion. The clam shells are also shaped to accommodate a removable water tank.

38 Claims, 20 Drawing Sheets

WALLPAPER STEAMER

BACKGROUND OF THE INVENTION

This invention relates to a hand-held wallpaper steamer for use in stripping wallpaper and other surface coverings secured to a surface by a heat and/or moisture softenable adhesive.

The invention relates particularly to a steamer intended for use by a handyman and must, therefore, be comfortable to hold when being used. The steamer must also be of a construction that enables it to be manufactured economically. The steamer must also be effective and reliable and be easy to operate. Generated steam must be capable of being applied without waste to a desired area of wall covering.

According to the present invention, a hand-held, wallpaper steamer for use in wallpaper stripping comprises a housing with a base open at one face to form a chamber with a peripheral wall which is placed against wallpaper to be stripped, the housing having a handle spaced from the base and extending in a direction generally parallel to the base.

Alternatively, a hand-held wallpaper steamer for use in wallpaper stripping may comprise a housing of two-part construction and providing a base portion forming a steam chamber open at one face and which is placed against wallpaper to be stripped, a water tank accommodated in the housing which also has an integral handle spaced from the base portion.

A further form of hand-held wallpaper steamer according to the invention may comprise a housing with a base open at one face to form a chamber with a peripheral wall which is placed against wallpaper to be stripped, the housing having, between its ends, a column extending away from the base, being contoured on one face to receive a water tank and on another face to form a handle that is spaced from the base and extends in a direction generally parallel thereto.

Another form of hand-held wallpaper steamer according to the invention may comprise a housing of two-part clam shell construction, a base portion open at one face to form a chamber of generally rectangular shape with a peripheral wall which is placed against wallpaper to be stripped, the clam shells also being contoured to receive the base portion and to form a handle spaced from the base and extending in a direction generally parallel to the base portion.

A still further form of hand-held wallpaper steamer embodying the invention may comprise a housing of two-part clam shell construction open at one end, a base portion with a floor and a peripheral wall to form a chamber open at one face, the clam shells being contoured to receive the base portion at the open end of the housing to close that end, the clam shells also being contoured to form a handle spaced from the base portion and extending in a direction generally parallel thereto, a steam generator located in the housing and having a series of spaced steam outlets, the floor having a surface that faces inwardly of the housing and which carries a series of spaced apertured bosses that provide communication from the steam outlet into, the chamber.

BRIEF DESCRIPTION OF THE DRAWINGS

An embodiment of the invention will now be described in greater detail with reference to the accompanying drawings of which.

DESCRIPTION OF THE PREFERRED EMBODIMENT

Figure 1:
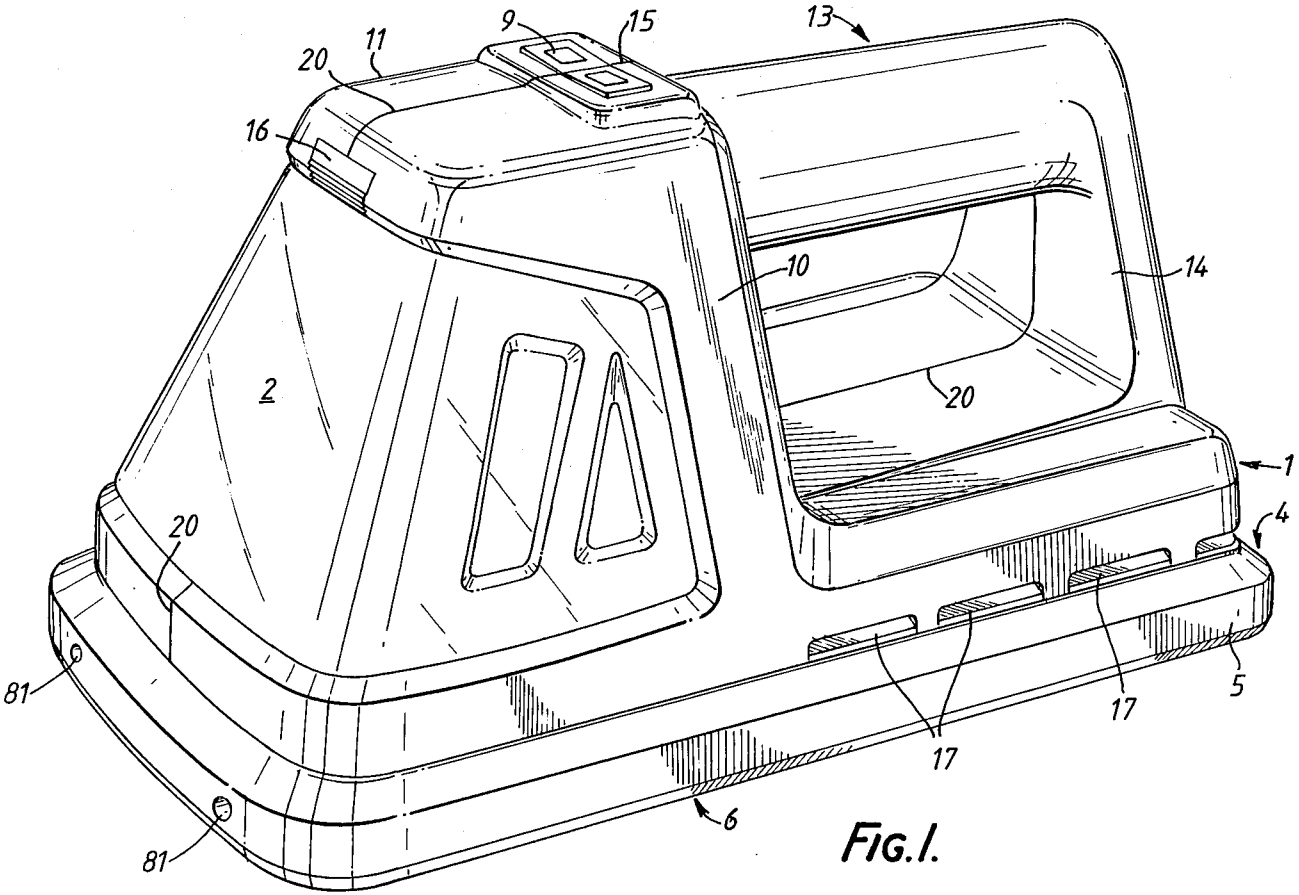
FIG. 1 is a perspective view from the front, one side and above of the embodiment.

The embodiment now to be described is suitable for steaming wallpaper prior to stripping the paper with a conventional stripping knife. However, the embodiment may also be used when stripping other surface coverings secured to the surface by heat and/or moisture softenable adhesives.

The embodiment comprises a hand-held steamer with an "on-board" water supply that is replenishable by a user as necessary.

As can be seen from FIGS. 1, 2 and 3, the embodiment includes a housing 1 contoured to accommodate a detachable water tank 2, a steam generator 3 and a base portion 4 with a peripheral wall 5, thereby forming a downwardly-open (as viewed in FIGS. 1, 2 and 3) chamber 6, hereinafter referred to as a steam chamber. Water from water tank 2 is pumped into a water chamber in the steam generator by an electrically powered pump shown diagrammatically at 7. Energisation of pump 7 is controlled by an electric switch 8 operated by a rocker arm 9. Steam from the steam generator 3 leaves the latter via exit holes in its lower face and emerges into the steam chamber via connectors described below.

The housing 1 includes a central portion 10 which extends away from the base portion 4 and has a forward projection 11 beneath which the water tank 2 is located on a flat part 12 of the housing 1. Extending rearwardly from the uppermost part of portion 10 is a handle 13 of generally cylindrical shape and which terminates in a flat end 14 of triangular shape and which is part of the housing 1 thereby forming a handle of a closed loop configuration. The cross-sectional size of the handle 13 in a plane transverse to its length is much smaller than that rear face of portion 10 from which the handle 13 extends.

Figure 2:
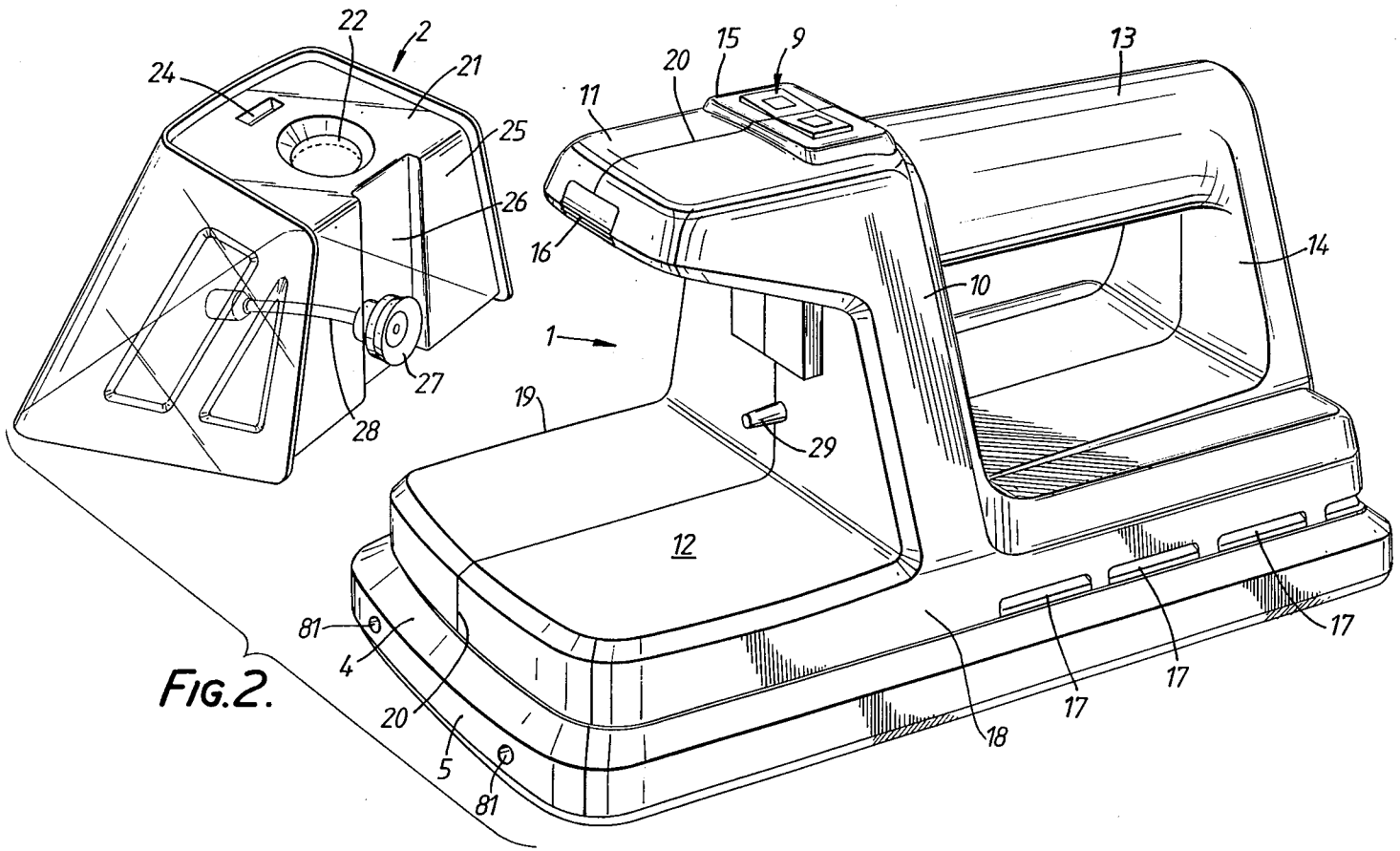
FIG. 2 is a perspective view similar to that of FIG. 1 but with one part shown separated from the remainder of the embodiment.
Figure 3:
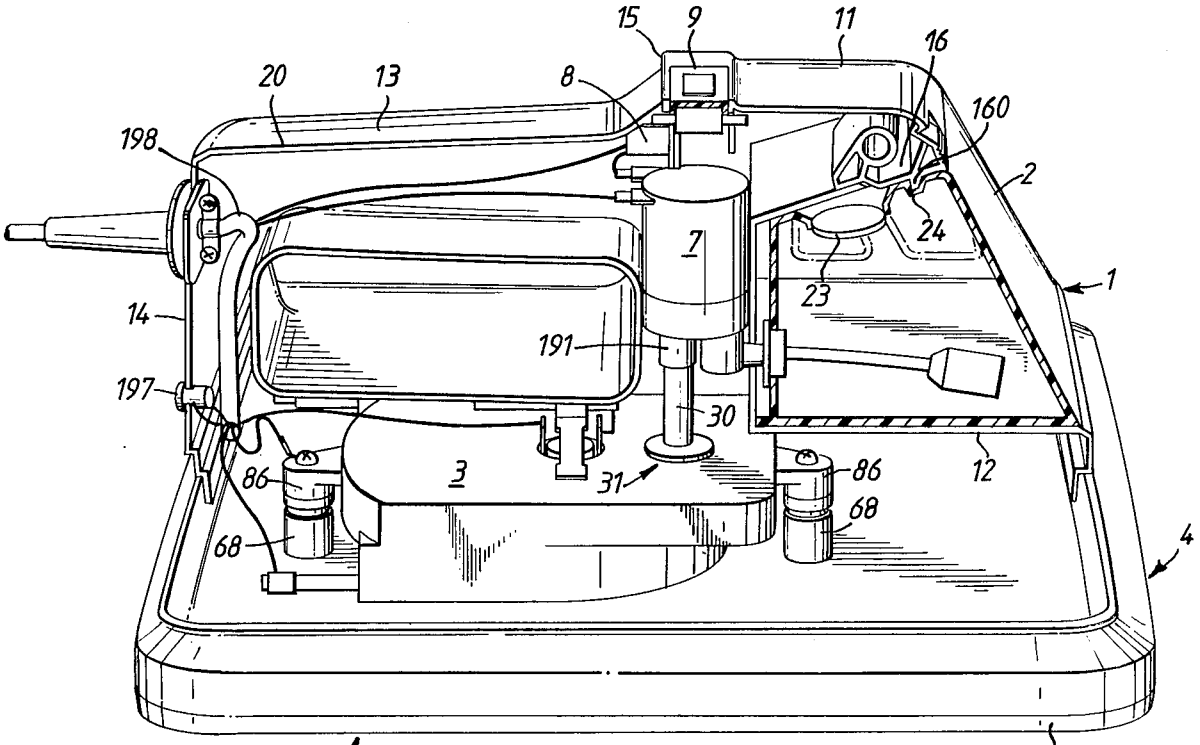
FIG. 3 is a schematic perspective view from one side with a part removed to reveal the position of certain internal components.

As can be seen, the upper surface (as seen in FIGS. 1, 2 and 3) of projection 11 is contoured as at 15 to accommodate the rocker arm 9 that operates the switch 8.

Located in the forward projection 11 of the housing 1 is a catch 16 for retaining the water tank 2 in the position in which it is shown in FIG. 1. As will be explained in more detail below, catch 16 can be actuated by a user to release the water tank 2 prior to detaching the tank from the housing. The catch 16 is so contoured that it is displaced by the tank 2 on initial movement of the latter into the position shown in FIG. 1. On final movement of the tank 2, the catch 16 automatically returns to a tank retaining position.

The housing 1 has, on both sides, air holes 17 which allow air to circulate within it so limiting heat transfer from the steam generator 3 to the housing 1.

The water tank 2 is of generally cubic form but is contoured to blend in with the contours of the housing 1 when in position thereon. The upper wall 21 of the water tank 2 has a filler hole 22 normally closed by a removable stopper 23. The upper wall 21 also has a rectangular recess 24 which co-operates with catch 16 to retain the water tank in position on the housing i.

The rear wall 25 is recessed as at 26 to accommodate a connector 27 forming part of a water inlet tube 28 inside the water tank 2 and described in more detail below. The connector 27 automatically engages with a short nozzle 29 of pump 7 in the portion 10 of the housing 1 as the water tank 2 reaches its fully home position on the housing.

The nozzle 29 is the output nozzle of pump 7 as will be described in more detail. The output of pump 7 is joined by a connector tube 30 to an inlet 31 of the steam generator 3.

The housing 1 is of clam shell construction and is formed by two clam shells 18 and 19 which abut along a vertical fore and aft plane through the middle of the steamer. The line is indicated at 20 in FIGS. 1, 2 and 3.

The clam shells 18, 19 are moulded from a suitable plastics material for example talc filled polypropylene and are contoured on one face—the inner face—to support the components mounted inside the housing formed when the clam shells are placed together.

The clam shells 18, 19 are generally similar as regards their external faces, each providing one half of the following parts of the housing 1 - central portion 10, the forward projection 11, the flat part 12, the handle 13 and the flat end 14.

In FIGS. 5, 6, 7 and 8, which show the left-hand clam shell 18, the portions thereof that make up the parts just listed are indexed 10A, 11A, 12A, 13A and 14A. A similar system in identification is used in FIGS. 9, 10, 11 and 12 which show the right hand clam shell 19, except that the letter B is used instead of the letter A.

The clam shells 18, 19 are contoured in such manner that, when placed together in mating relationship, they provide the generally "wedge" shape of the housing 1 when seen from the front or rear, i.e. the gradual inwardly tapering from the lower and widest part to the upper and narrowest part. That configuration can be seen in FIGS. 7, 8 and 11, 12.

Clam shell 18 (FIG. 6) has a groove 32 round the major part of its periphery. The inner face (that visible in FIG. 6) of clam shell 18 has a number of ribs projecting from it of which ribs 33, together with correspondingly numbered ribs on clam shell 19, support switch 8 and rocker arm 9, semi-circular recesses 34 in those ribs providing bearing surfaces for the rocker arm 9 as will be described below. The switch 8 is supported in a recessed portion 33A of one of the ribs 33 and is held in position, as will be described below, by the engagement of resilient fingers on the switch 8 in channels 33B above and below (as viewed in FIG. 6) the recessed portion 33A. Adjacent the recesses 34, the clam shell is cut away as at 35 to give access to the upper surface of the rocker arm 9.

Further ribs 36, 37, together with corresponding ribs on clam shell 19, together define the location of pump 7. An additional small rib 37A helps to support the pump 7.

In the portion 11A of clam shell 18 is a transverse rib 38 which, together with a corresponding rib 38 in clam shell 19, forms one wall of a compartment in which the catch 16 is housed. A support stub 39 formed in the compartment forms with a corresponding stub in clam shell 19, a mounting for the water tank retaining catch 16. Ribs 40 extend radially from the stub 39 to strengthen portion 11 and to support the catch 16. Adjacent the stub 39 the clam shell is cut away as at 41 to receive part of the catch 16.

Figure 5:
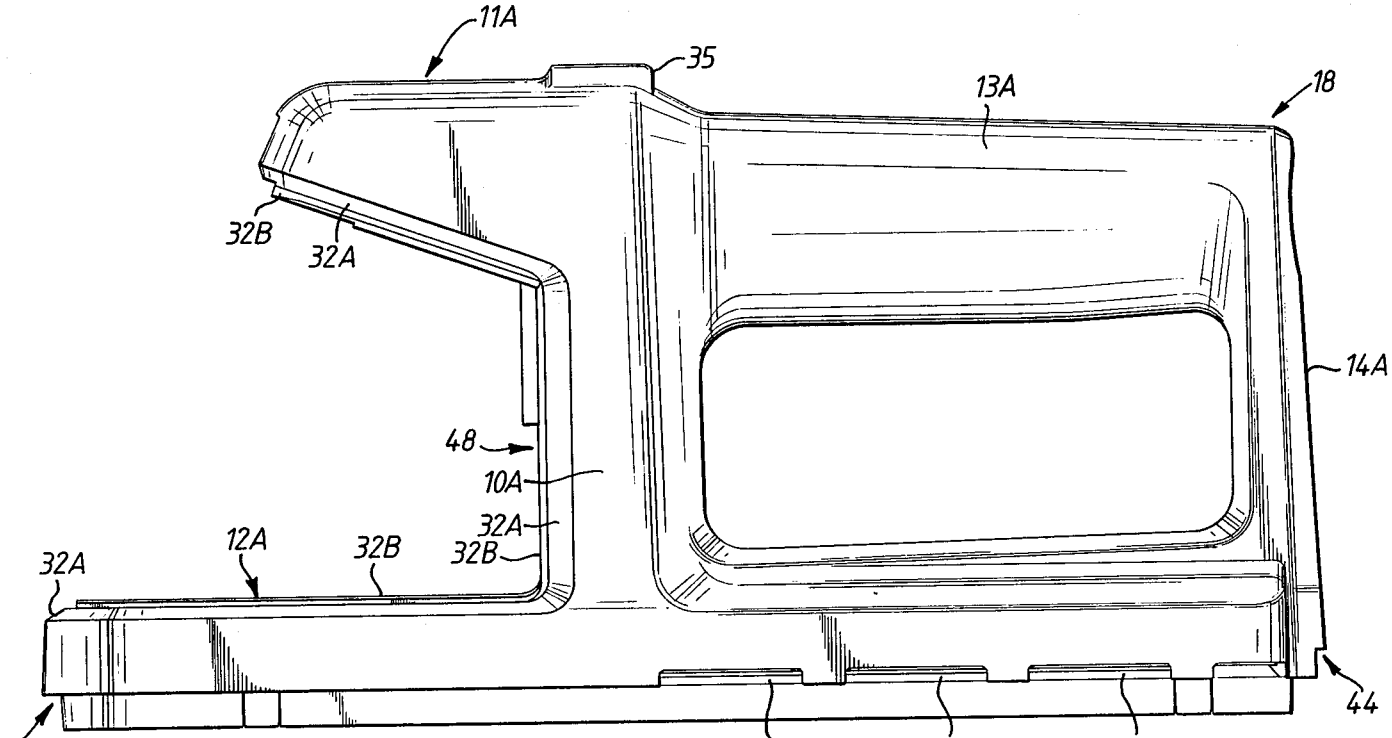
FIGS. 5, 6, 7 and 8 are, respectively, a view from one side, a view from the opposite side, a rear view and a front view of a part of the housing of the embodiment.
Figure 6:
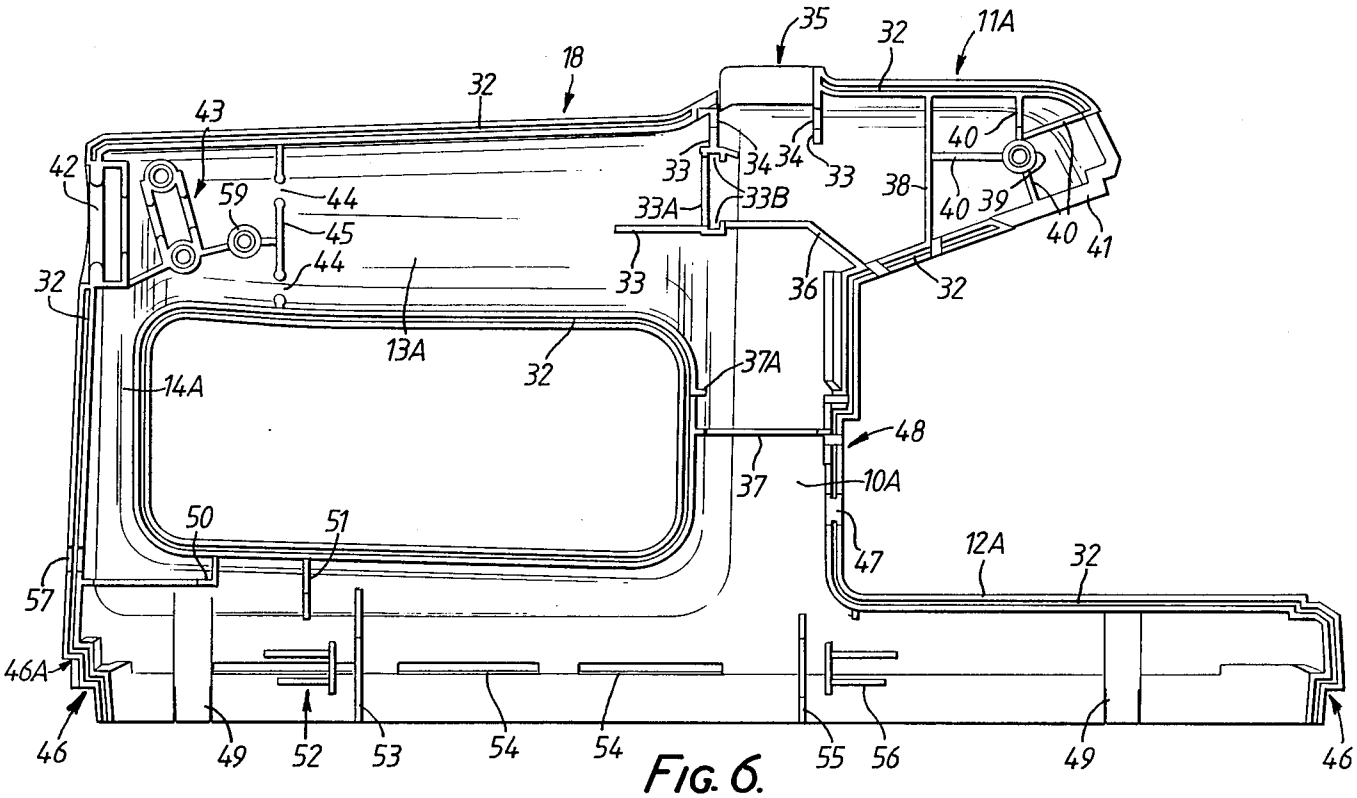
Figure 7:
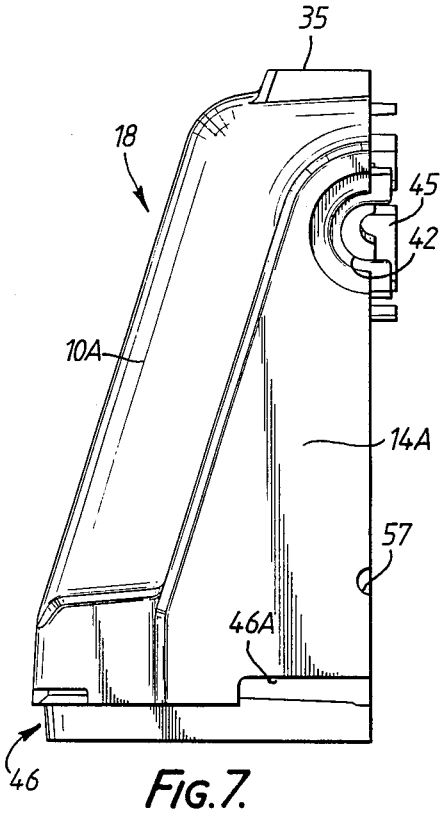
Figure 8:
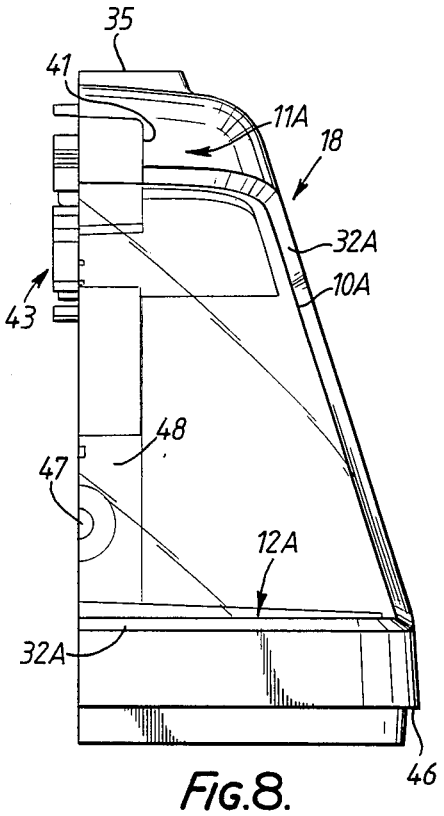

As can be seen from FIG. 5, the edge of the clam shell 18 beneath the portion 11A is bevelled as indicated at 32A, the bevel extending down the edge of the portion 10A and along the edge of the portion 12A. The bevel is continued outwards for a short distance by a narrow flange 32B.

Within the handle portion 13A of clam shell 18 is one half of a cable entry 42 adjacent which is a moulding 43 for the reception of a jaw (not shown) and which, together with moulding 43, forms a cable clamp. Gaps 44 in a transverse rib 45 allow passage of electric cables as will be described below.

Round its lower edge, the clam shell 18 is stepped as at 46 to receive a corresponding stepped edge of the base portion 4 as will be described in more detail below.

Beneath rib 37, one edge of the clam shell 18 has a semi-circular recess 47, the adjacent face of the clam shell also being recessed as indicated at 48. The step 46 is extended upwardly for a short distance at the lower rear of downturn 14A as indicated at 46A.

The internal face of clam shell 18 also has bosses 49 with downwardly open blindbores (not shown) and further sets of ribs 50 to 56 which assist in the support and location of the steam generator 3.

The rear face of the downturn 14A is formed with a semi-circular recess at 57 to receive a neon indicating lamp as will be described below.

To enable the clam shells 18, 19 to be secured together, a screw boss 59 is provided through the wall of the shell 18. In addition, stub 39 also has a bore to receive a securing screw.

Referring now to FIGS. 9, 10, 11 and 12 which show the right hand clam shell 19, it will be observed that the external face (that shown in FIG. 9) is generally similar to that of the left-hand clam shell 18 as shown in FIG. 5.

Figure 10:
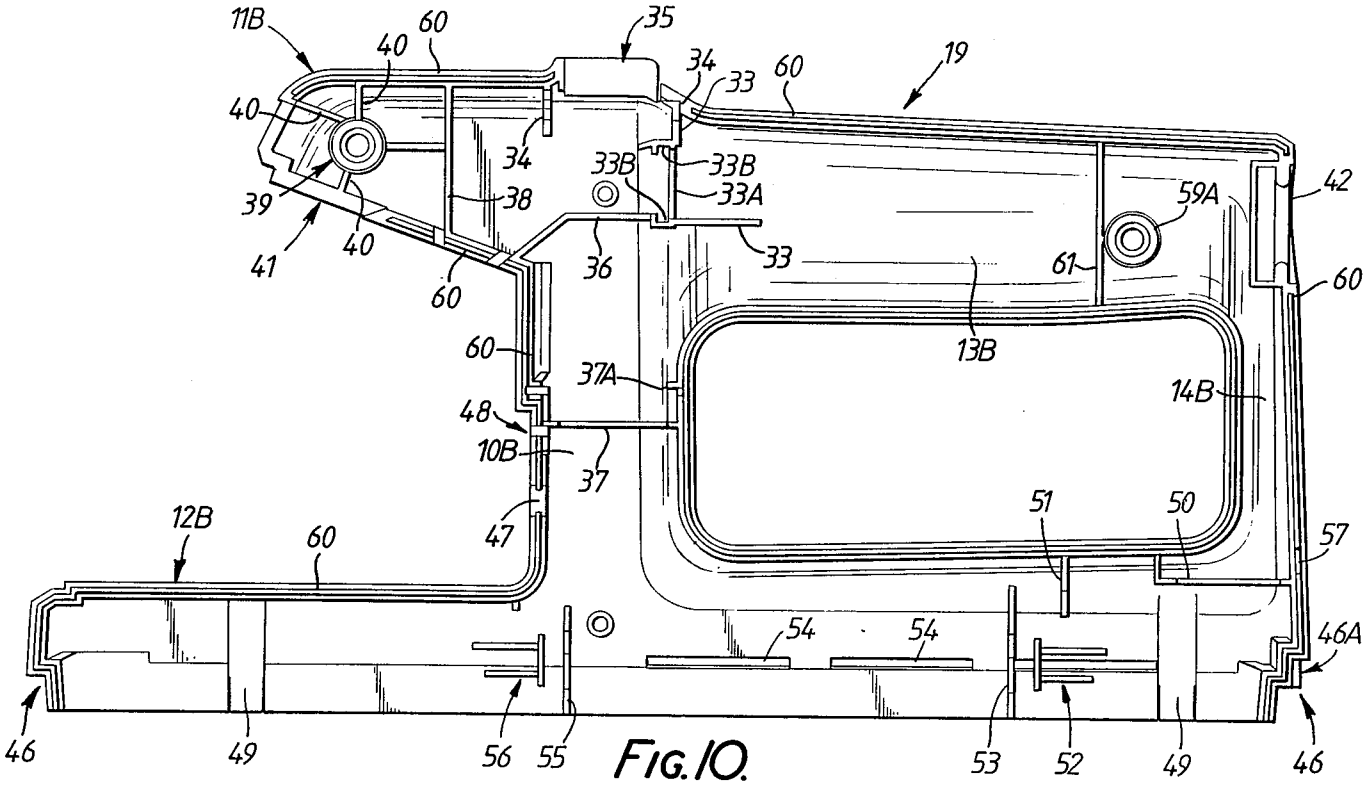
Figure 11:
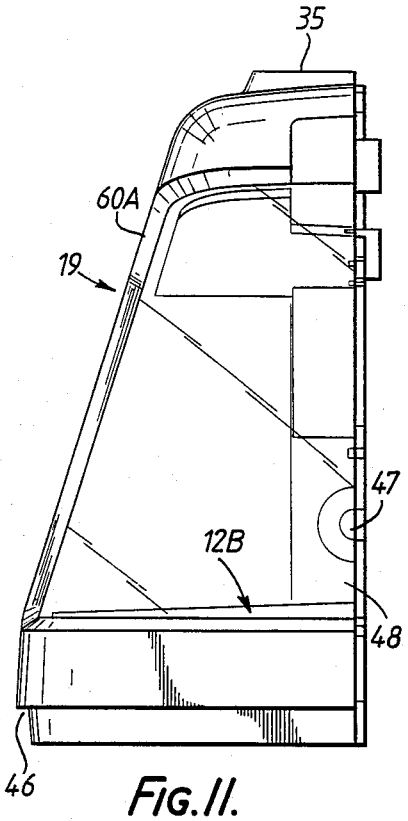
Figure 12:
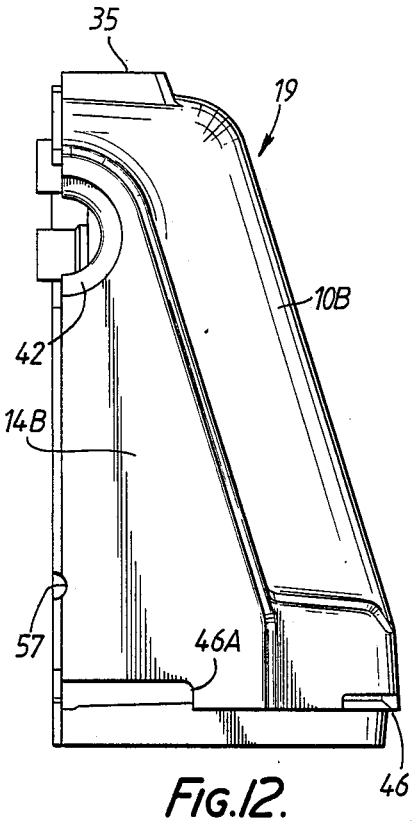

The inner face of clam shell 19 is shown in FIG. 10. Round the major part of the periphery of that face is a rib 60 that locates in the groove 32 on clam shell 18 when the clam shells are mated.

Figure 9:
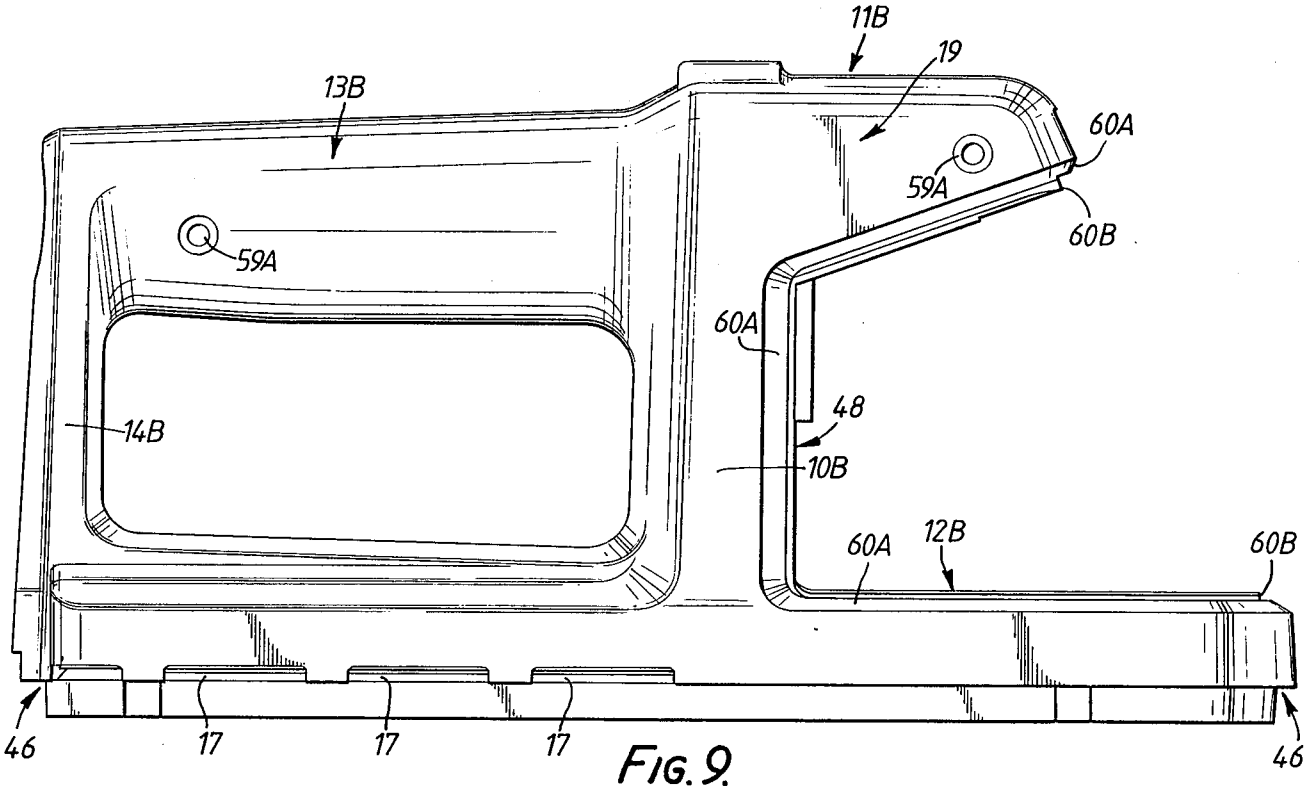
FIGS. 9, 10, 11, and 12 are, respectively, a view from one side, a view from the opposite side, a front view and a rear view of another part of the housing of the embodiment.

As can be seen from FIG. 9, the edge of clam shell 19 beneath the portion 11B is bevelled as indicated at 60A, the bevel extending down the edge of the portion 10B and along the edge of the portion 12B. The bevel continues outwardly for a short distance as a narrow flange 60B.

As with the inner face of clam shell 18, that of clam shell 19 has a number of ribs projecting from it in positions corresponding with those of clam shell 18 and the same reference numbers have been used to denote corresponding ribs. Thus, in FIG. 10, ribs 33 assist in supporting switch 8 and rocker arm 9, the semi-circular recesses 34 on those ribs completing the bearing surfaces for the rocker arm. Adjacent the recesses 34, clam shell 19 is cut away as at 35 to complete the access to the upper surface of the rocker arm 9.

Ribs 36, 37, corresponding with the similarly numbered ribs on clam shell 18, complete the definition of the location of the water pump 7 and a further small rib 37A provides support for the pump.

Transverse rib 38 on clam shell 19 co-operates with rib 38 on clam shell 18 to form the wall of the compartment in which catch 16 is housed. Support stub 39 on clam shell 19 completes the support for the catch 16. Support stub 39 on clam shell 19 is contoured to engage the end of the corresponding stub 39 on clam shell 18 and has a stepped external configuration to engage and locate a part of the tank catch 16 as will be described below. Clam shell 19 also has ribs 40 corresponding with those on clam shell 18 and is also cut away in a corresponding manner at 41. Clam shell 19 also has ribs 52 to 56 which provide support and location for the steam generator 3 and corresponds with the correspondingly numbered ribs on clam shell 18.

Clam shell 19 has the other half of the cable entry 42 and also has an adjacent rib 61 which bridges the gaps 44 in the rib 45 of clam shell 18.

The contour of the lower edge of clam shell 19 corresponds with that of claim shell 18 being stepped at 46. Step 46 on clam shell 19 is also extended upwardly for a short distance at the lower rear of downturn 14A as indicated at 46A.

There is a recess 47 in the edge of clam shell 19 and the adjacent face of the clam shell is also recessed as indicated at 48.

As with clam shell 18, the rear face of the downturn 14B has a semi-circular recess 57 to complete the space provided to receive the neon indicator.

A screw hole 59A in clam shell 19 permits the passage through the wall of the shell of one of the screws that holds the clam shells together. Support boss 39 is also apertured to receive a securing screw.

Figure 13:
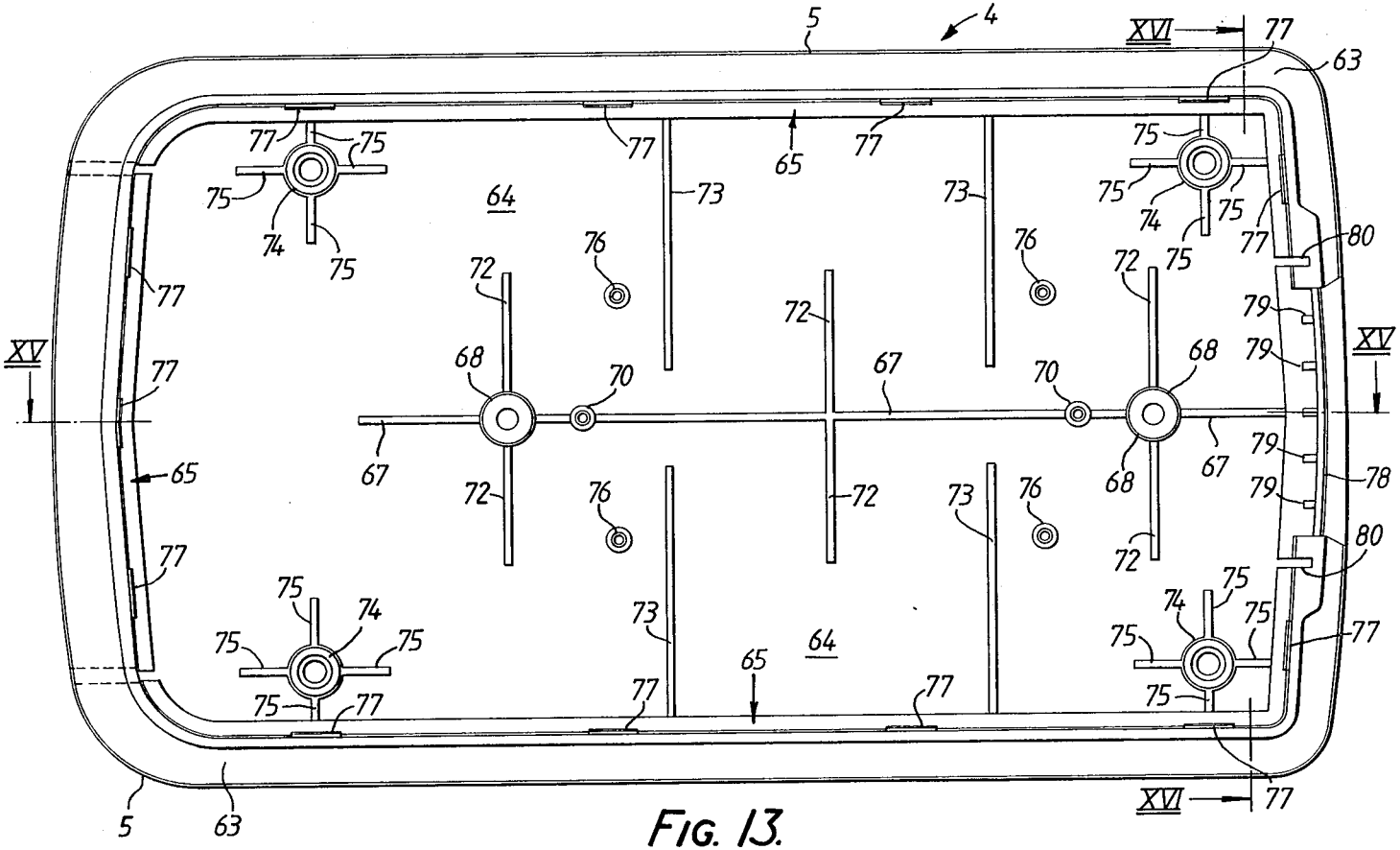
FIGS. 13 and 14 are, respectively, a view from above and a view from below of a further part of the housing of the embodiment.
Figure 14:
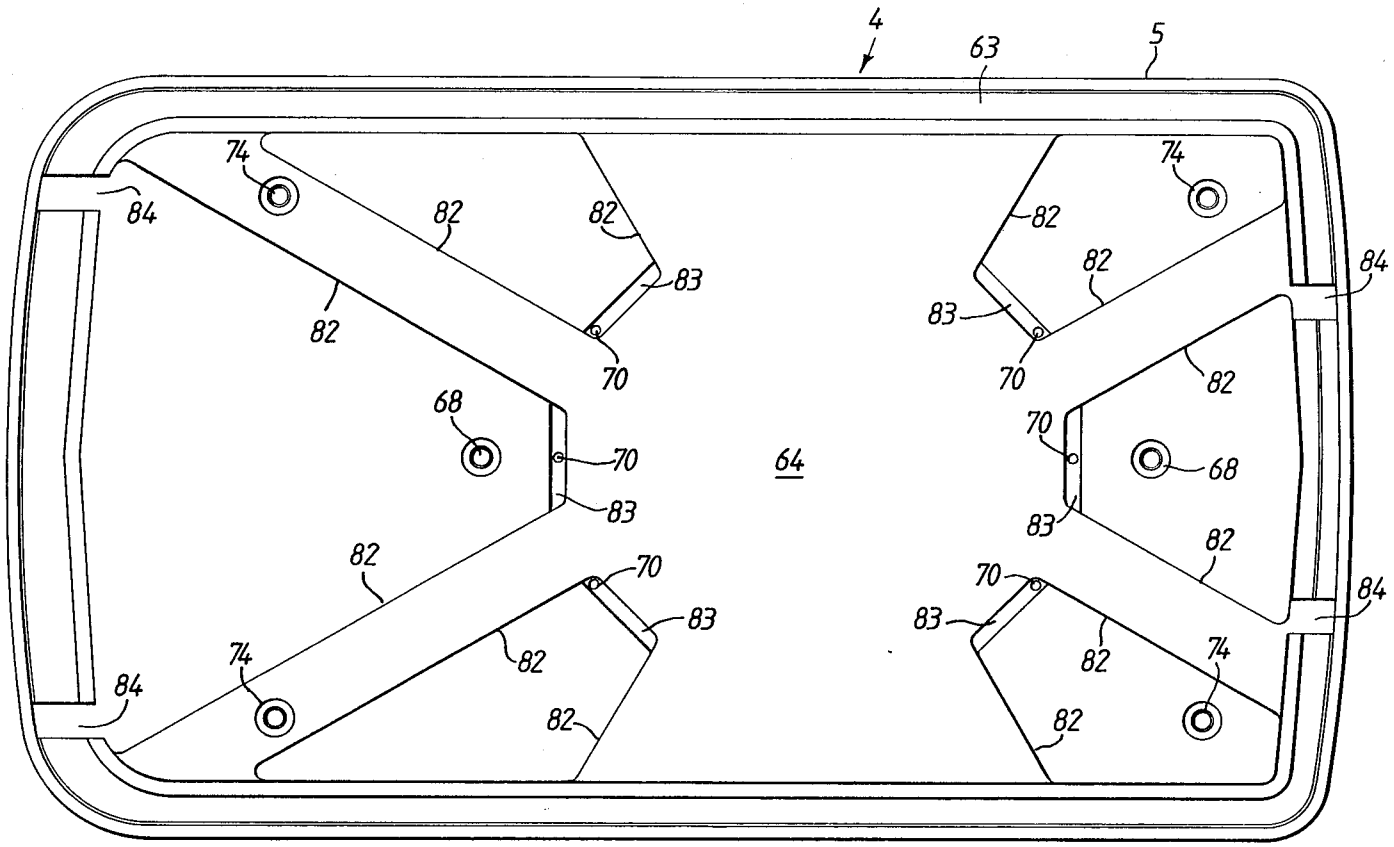

The base portion 4 of the embodiment is shown in FIGS. 13, 14, 15 and 16 and is of generally rectangular form when seen in plan as in FIGS. 13 and 14.

The base portion 4 which is of a plastics material, for example a glass fibre reinforced thermosetting polyester, or a thermoplastic polyester which is preferably glass fibre reinforced, has the peripheral wall 5 whose external shape is contoured as at 63 to merge smoothly with the lower surface of the clam shells 18 and 19 when those parts ar assembled together.

Figure 15:
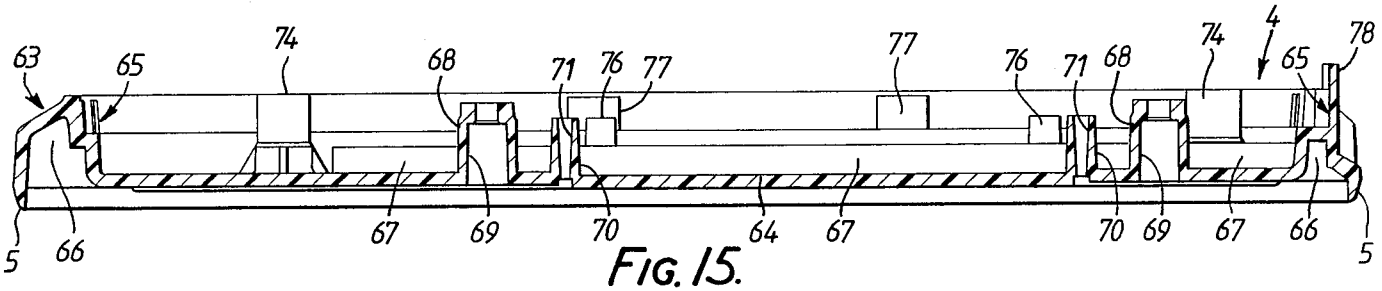
FIGS. 15 and 16 are, respectively, a section on the lines XV and XVI of FIG. 13.
Figure 16:
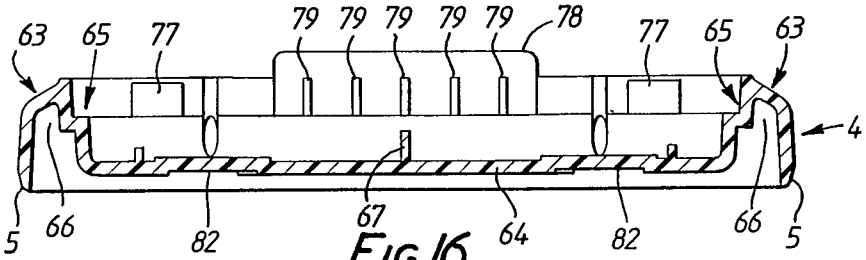

The gutter 66 is of somewhat greater width at its open or lower face, as viewed in FIGS. 15 and 16, across the left-hand edge of the base portion 4 as viewed in FIG. 13, than it is along the side and rear edges of the base portion. This can be observed by comparing the width of the gutter 66 at the left-hand end of FIG. 15 with the width at the right-hand end and with the equal widths at both ends of the base portion as shown in FIG. 16, and this is for aesthetic reasons.

The interior contour of the gutter follows that of the wall 5 and the stepped portion 65 of the upturned edge of the floor 64.

As can be seen from FIGS. 15 and 16, the wall 5 extends downwardly beyond the lower face of the floor for a short distance to form side walls for the steam chamber 6, the lower ends of the walls being bevelled as shown. The extent of the extension is determined by the need to create a sufficient volume beneath the floor 64 to allow the steam emerging into the steam chamber to disperse evenly throughout the chamber whilst ensuring, at the same time, a concentration of steam that is effective to soften the wallpaper adhesive. In the steamer shown in the drawing, the extension is about 5 mm.

The base portion has a floor 64 whose periphery is upturned and stepped as at 65 to mate with the step 46 on the clam shells. The upturn is spaced from the wall 5 to form a recess or gutter 66 round the inside of the wall 5. The formation of the recess or gutter 66 strengthens the base portion at its periphery and also serves to collect water as will be described below.

The capacity of the gutter 66 is sufficient to retain the condensation that normally occurs during a period of use equal to one filling of the water tank 2. The volume of the condensation is not large because a substantial proportion of the total condensation produced is absorbed by the wallpaper. Another factor bearing on the capacity of the gutter is the extent to which the gutter deleteriously affects the dispersal of steam within the steam chamber and clearly this extent must be small.

In the steamer shown in the drawings, the maximum depth of the gutter through its length is about 26 mm measured from the lower edge of the wall 5. The maximum width at the lower open end of the gutter is about 14 mm. That maximum occurs along the left-hand edge of the base portion as viewed in FIG. 15. Elsewhere the gutter width at its open end is about 10 mm.

The face of floor 64, seen in FIG. 13 and referred to as the upper face, has a series of upstanding strengthening ribs of which rib 67 lies on the longitudinal centre line of the floor and extends almost the full length of the floor. The rib 67 bridges upstanding bosses 68 with stepped bores 69 and nozzles 70 with bores 7 that are of decreasing diameter in a downward direction towards floor 64. Short transverse ribs 72 extending from rib 67 strengthen the floor 64 as do further transverse ribs 73 interspersed with ribs 72 and extending towards rib 67 from the sides of the floor.

Further apertured bosses 74 extend upwardly from the floor 64 in positions that correspond with the bosses 49 on the clam shells 18, 19. The bores of the bosses 74 are also stepped internally but this is not shown in the drawings. The bosses 74 are strengthened by short radially extending ribs 75.

In addition to the nozzles 70, the floor 64 has further nozzles 76 located in the positions shown in FIG. 13 and which are identical with the nozzles 70.

Areas 77 in the sides of the base portion 4 are bearing areas on which the edges of the clam shells locate when they are assembled to the base portion.

Figure 4:
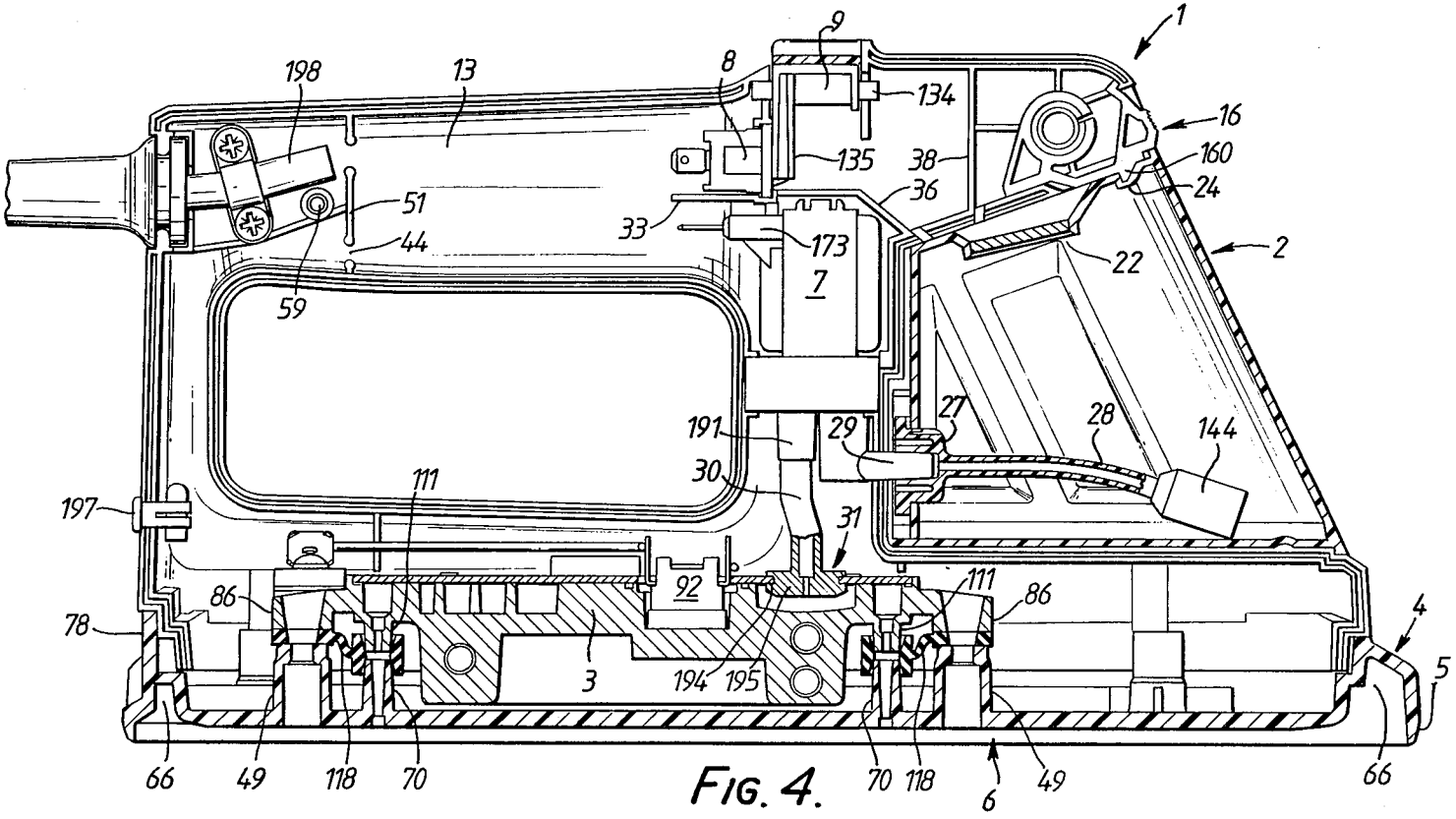
FIG. 4 is general assembly sectional view of the embodiment.

The right-hand (as seen in FIGS. 13 and 15) end has an upstand 78 strengthened on its inside face with short ribs 79. At the end of the upstand 78 are slightly raised portions 80. Upstand 78 locates in the extension 46A in the clam shells and provides an area for the reception of a rating plate as can be seen in FIG. 4.

Air holes 81 in the front part of the wall 62 assist in ventilating the interior of the housing.

The lower face of the base portion 4 is shown in FIG. 14, the lower end openings of the bosses 68, nozzles 70 and bosses 74 being correspondingly referenced. Areas in the lower face bounded by lines 82 are recessed slightly with respect to the remainder of the face, the nozzles 70 being located adjacent the inner ends of those areas in regions 83 which are recessed with respect to recesses 82.

Raised areas 84 in the contour 63 provide weirs between adjacent sections of the gutter 66 that tend to restrain movement of condensate along the gutter.

Located within the housing i above the floor 64 is the steam generator 7 and this is shown in more detail in FIGS. 17 to 24.

Figure 17:
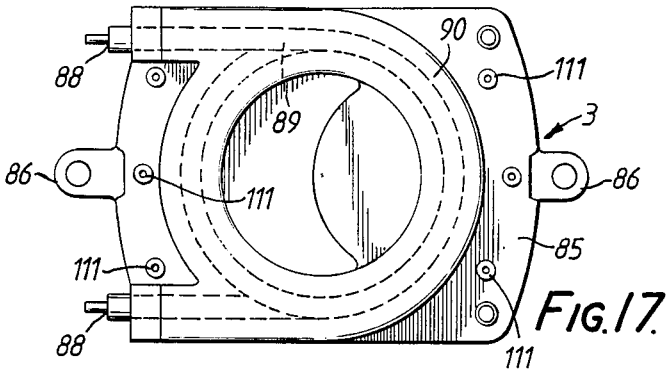
FIG. 17 is an underneath view of another component of the embodiment.

As can be seen from FIG. 17, the steam generator 3 is of generally rectangular form when viewed from above. The generator has a body 85 of a heat conductive metallic light alloy. Projecting from the ends of the body 85 are mounting ears 86 apertured to receive mounting screws (not shown).

Figure 22:
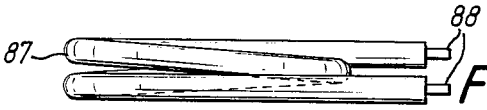
FIG. 22 is a side view of a part of the component of FIG. 17.

Cast integrally with the body 85 is an electric heating element 87 of the sheathed, resistance kind and shown in FIG. 22. The ends of the element are indicated at 88 and the path followed by the element is indicated in dotted lines 89 in FIG. 17. As can be seen, the element is looped at one end, the body 85 being locally increased in thickness at 90 to accommodate the loop and other parts of the length of the element.

Figure 18:
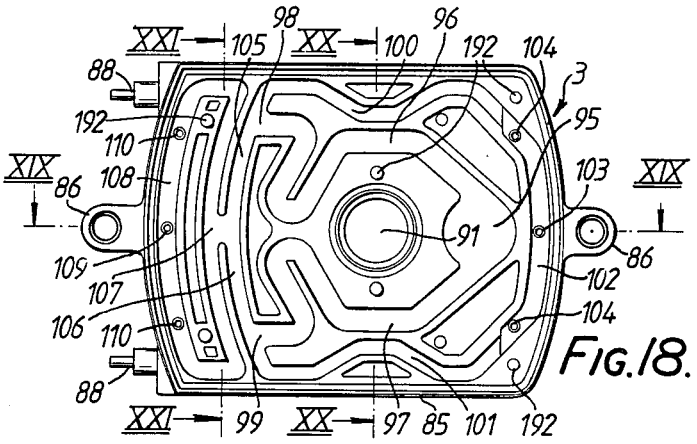
FIG. 18 is a plan view of the component of FIG. 17 with part removed.
Figure 19:
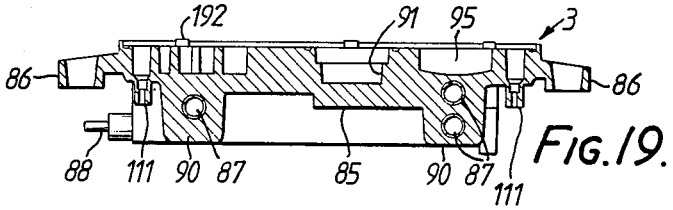
FIGS. 19, 20 and 21 are, respectively, sections along the lines XIX, XX and XXI of FIG. 18.
Figure 20:
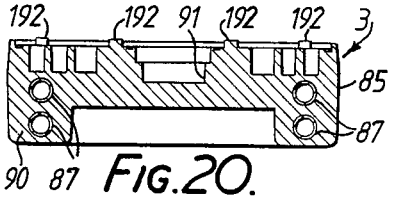
Figure 21:
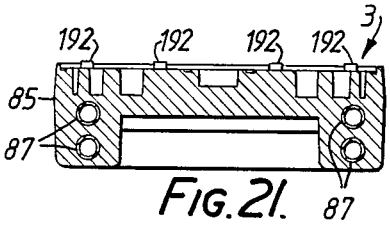

The upper (as seen in FIG. 18) face of the body 85 is channeled as will be described below and has a central recess 91 that accommodates a thermally responsive element 92 in good thermal contact with the body 85. The upper face of the body 85 is covered by a cover plate 92 apertured at 93 to give access to the element 92 and at 94. The plate 92 is slightly recessed round the aperture 94. The cover plate 92 is secured to the body 85 in a manner described below.

The channeling in the upper face of the body 85 is seen in FIG. 18. The face has a water receiving chamber 95 of circular form when seen in plan as in FIG. 18. The water chamber 95 is located beneath aperture 94 of plate 92. From diametrically opposed positions on the chamber 95 extend passages 96, 97 of serpentine elongate form which are mirror images of each other. The passages 96, 97 terminate in common areas 98, 99 respectively. From the common areas 98, 99 extend further serpentine elongate passages of which two 100, 101 lie along the sides of the body 85 and pass to the right hand (as viewed in FIG. 18) side of the wafer chamber 95 where they join a common transverse passage 102. In the centre of the transverse passage 102 is a steam exit 103 and while other steam exits 104 are located in the vicinity of the junctions with the transverse passage 102 of the passages 100, 101.

Also extending from the common areas 98, 99 are further passages 105, 106 which after merging at 107 diverge in opposite directions to join a common transverse passage 108. In the centre of transverse passage 108 is a further steam exit 109 whilst other steam exits 110 are located in the vicinity of the junctions with the transverse passage 108 of the passages 105, 106.

The distances from the common areas 98, 99 along the passages 100 and 101 to the steam exits 104 and along the passages 105, 106 to the steam exits 110 are substantially equal.

Figure 24:
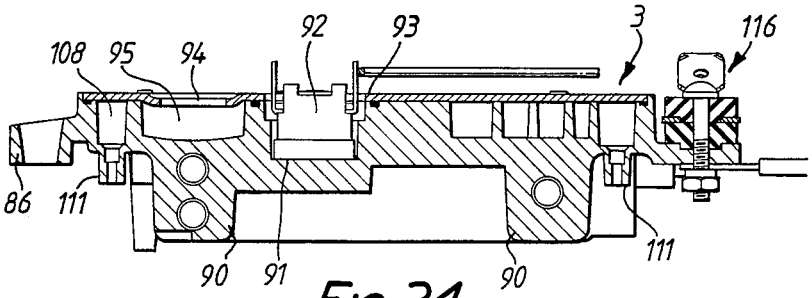
FIG. 24 is a section on the line XXIV of FIG. 23.

As can be seen from FIG. 24, the steam exits 103, 104, 109 and 110 are at the upper ends of respective nozzles 111 formed in the body 85 and that project downwardly from the lower face of the body 85. The locations of the nozzles 111 correspond with those of the nozzles 70 and 76 of the floor 64 of the base portion 4.

The looped end of the heating element 87 is located in the general area beneath water chamber 95 thereby ensuring a high heat input to this area sufficient to "flash" water entering the chamber into steam. The lengths and depths of the passages 96, 97, 100, 101, 102, 105, 106 and 108 are such as to provide surface area sufficient to ensure further heating, and therefore drying, of the steam exiting from water chamber 95. The physical mass of the body 85 is related to the electrical rating of the heating element 87 and is such that the latter is able quickly to bring the body 85 to a working temperature. The nozzles 111 provide a slight restriction on the flow of steam from the generator so that steam at the steam exits 103, 104, 109, 110 are at a pressure slightly above atmosphere.

Forming the passages and chambers in the same face of the body 85 facilitates manufacture as does the configuration shown of the passages.

Figure 23:
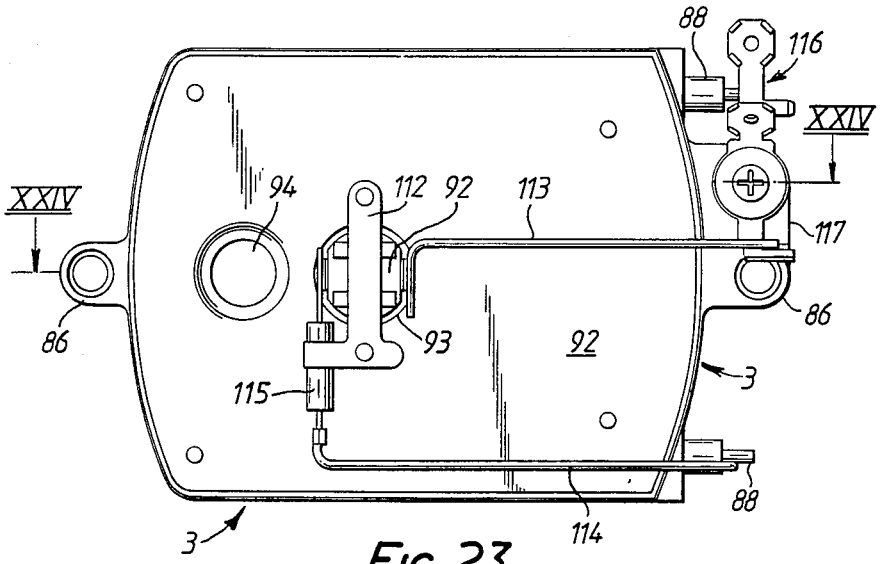
FIG. 23 is a plan view of the component of FIG. 17.

FIG. 23 also shows that the thermally responsive device is held in the recess 91 by a metal strap 112 secured in place in a manner described below. The device responds to the temperature of the steam generator and operates to keep the latter at a controlled temperature. Joined to the terminals of the device 92 are electrical conductors 113, 114 of which conductor 114 includes a thermal cut-out 115 to protect the steamer generator against over-heating. Conductor 113 is connected to an electrical terminal 116 mounted upon an extension 117 of the base 85 and insulated therefrom.

Figure 25:
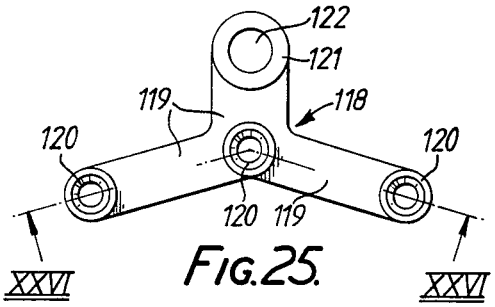
FIG. 25 is a plan view of another part of the embodiment.
Figure 26:
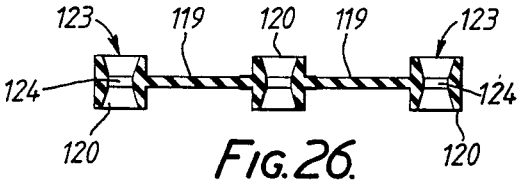
FIG. 26 is a section on the line XXVI of FIG. 25, FIGS. 27 and 28 are, respectively, side and plan views of a further part of the embodiment, FIGS. 29, 30 31; and 32 are, respectively, a plan view, a side view, a section on line XXXI of FIG. 29, and an underneath view of yet another part of the embodiment.

FIGS. 25 and 26 show a gasket seal/connector 118 of a thermally insulating material, for example silicon rubber which serves the double purpose of assisting to isolate the steam generator 3 thermally from the base portion 4 and also to provide sealing connections between the nozzles 111 of the steam generator and the respective nozzles 70 and 76 in the floor 64.

Thus, the gasket seal/connector 118 comprises webs 119 that join interconnections 120 and a gasket portion 121 with a central aperture 122. Each interconnection 120 extends for a short distance on both sides of the web 119 which is positioned centrally of the interconnections 120. Each interconnection has a central bore 123 with a central restricted throat 124.

Figure 27:
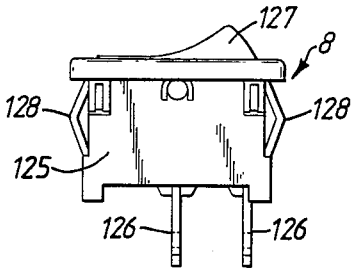
Figure 28:
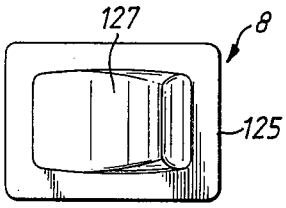
Figure 29:
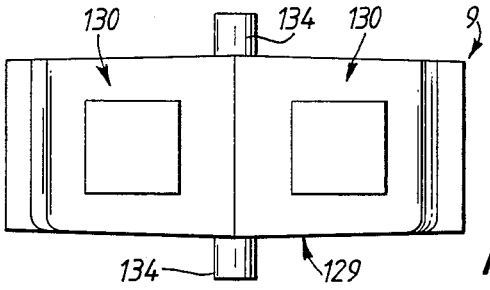
Figure 30:
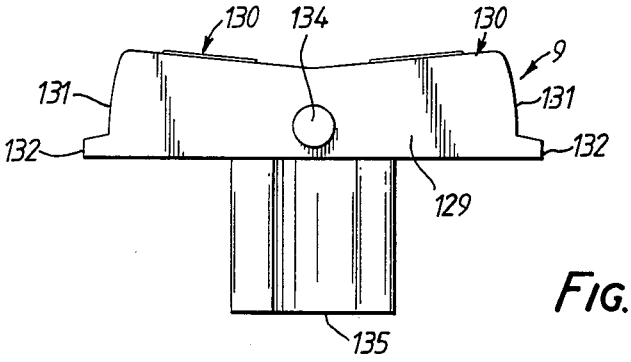

FIGS. 27 and 28 show detail of the switch 8. The switch has a body 125 which houses the switching contacts (not shown), connection to the latter being effected via external terminals 126. The switch contacts are operated by a rocker 127 that extends through an aperture in the upper (as viewed in FIG. 27) face of the switch body 125. On opposite sides of the switch body 125 are spring fingers 128 shaped as shown in FIG. 27 and which can be compressed towards the body 125.

Rocker 127 of the switch 8 is actuated by the rocker arm 9 referred to above and which is shown in more detail in FIGS. 29 to 32.

Rocker arm 9 is made of a suitable plastics material, for example acetal and comprises a horizontal (as viewed in FIGS. 29 to 32) arm 129 whose upper face has inclined surfaces 130 that terminate in sloping ends 131 and flanges 132. Each surface 130 has a central depression 133, each bearing a designation 'ON' or 'OFF'. Bosses 134 project from opposite side faces of the arm 129. One of those sides is extended away from arm 129 as seen at 135 to form an actuator for the rocker 127 of the switch 8.

Figure 31:
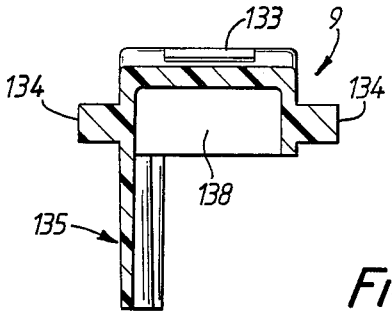
Figure 32:
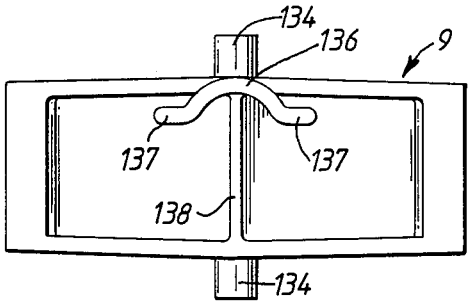

As can be seen from FIGS. 31 and 32, the cross sectional shape of the extension 135 is semi-circular over its central portion 136 with lateral flanges 137.

Extending internally between the sides of the arm 9 is a strengthening rib 138.

Figure 33:
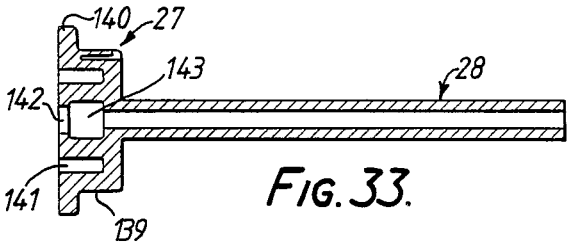
FIGS. 33 and 34 are, respectively, a section on line XXXIII of FIG. 34 and an end view of a component of the embodiment.
Figure 34:
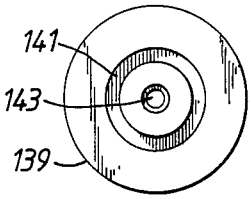

FIGS. 33 and 34 show in more detail the connector 27 and inlet tube 28 referred to above. The connector 27 is integral with the tube 28 and has a cylindrical portion 139 that fits into a hole in a wall of the water tank 2, inward movement being limited by a flange 140 round portion 139. An annular recess 141 in the outer face of portion 139 imparts a degree of flexibility to the portion. An inwardly extending lip 142 round one end of a central passage 143 through the connector ensures a watertight connection with the short nozzle 29 in the portion 10 of the housing.

Figure 35:
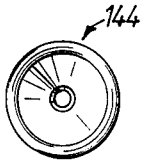
FIGS. 35, 36 and 37 are, respectively, a view from one end, a section on line XXXVI of FIG. 35, and a view from the other end of another component of the embodiment.
Figure 36:
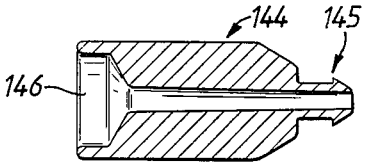
Figure 37:
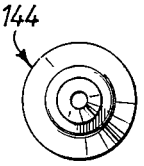
Figure 38:
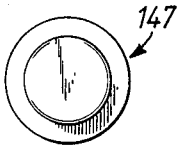
FIGS. 38 and 39 are, respectively, an end view of a further component of the embodiment, and a section on the line XXXIX of FIG. 38, FIGS. 40 and 41 are, respectively, a plan view of yet another component and a section on the line XLI of FIG. 40, FIGS. 42, 43 and 44 are, respectively, a side view of an additional component of the embodiment, an end view thereof and a section on the line XLIV of FIG. 42, and, FIG. 45 is a side view, partly in section, of yet a further component of the embodiment.
Figure 39:
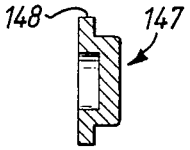

The inlet tube 28 terminates in an end fitment 144 shown in FIGS. 35, 36 and 37 of a material denser than water. The fitment 144 is cylindrical with an extension 145 at one end contoured to be entered into and be retained in that end of tube 28 remote from connector 27. The other end of the fitment 144 has a cylindrical recess 146 into which is inserted a porous plug 147 which acts as a filter and prevents small particles entering the tube 27. The plug 147 has a peripheral lip 148 which limits the extent of penetration of the plug 147 into the recess 146 and which also enables the plug 147 to be removed when necessary for cleaning or replacement.

Figure 40:
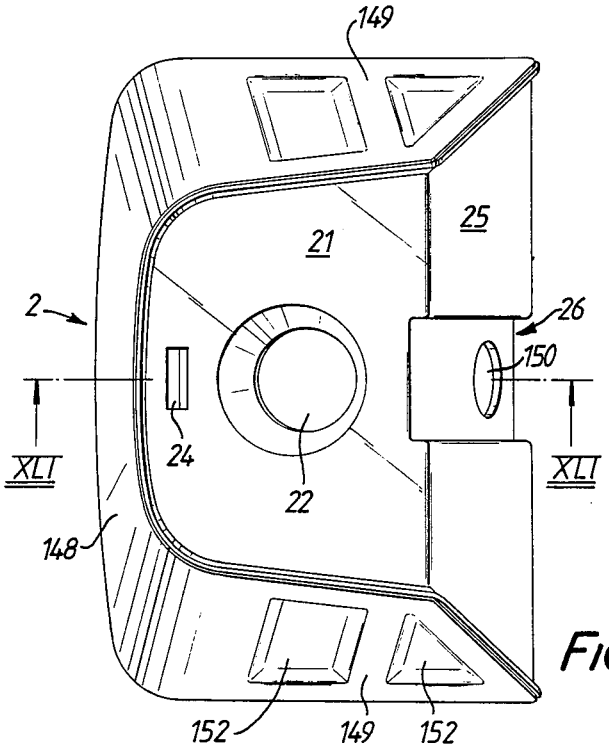
Figure 41:
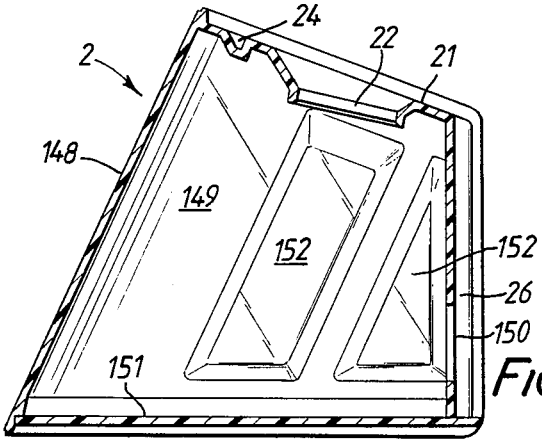

The water tank 2 is shown in more detail in FIGS. 40 and 41. As described above, the tank 2 is of generally cubic form and has front and side walls 148, 149 contoured to blend in with the contour of the housing 1. The upper wall 21 of the tank, which is inset slightly with respect to the upper edge of the front and side walls, slopes downwardly towards the rear wall 25 of the tank and has the filler hole 22 and the recess 24. The rear wall 25 is also slightly inset with regard to the rear edges of the side walls 149 has longitudinal recess 26 referred to above which accommodates the connector 27 and allows the remainder of the rear wall to be located in close proximity to the adjacent face of the portion 10 of the housing when the tank is correctly positioned on the housing 1. The connector 27 locates in a hole 150 in the recess 26.

Preferably, the tank walls are made of a clear plastics material so that a user can readily observe the volume of water in the tank and replenish it when necessary.

The floor 151 of the tank is also slightly recessed with respect to the lower edges of the front and side walls but it extends beyond the rear wall 25 as shown in FIG. 41.

The visual appearance of the tank 2 is enhanced by shaped depressions 152 in the side walls 149, such depressions serving also to impart a greater degree of rigidity to the side walls. The depressions also enable a user to grasp the tank more easily when withdrawing it from the housing.

Figure 42:
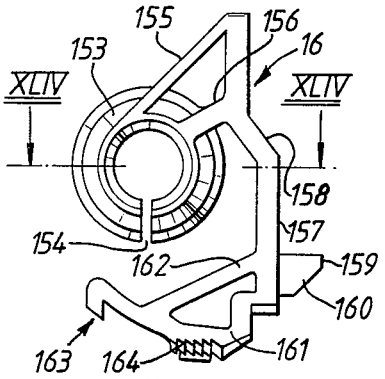
Figure 43:
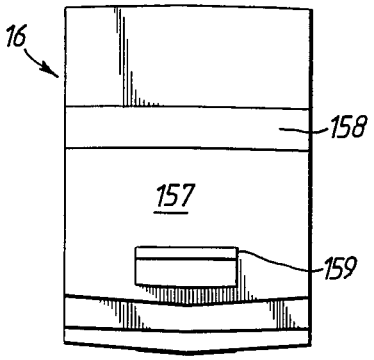
Figure 44:
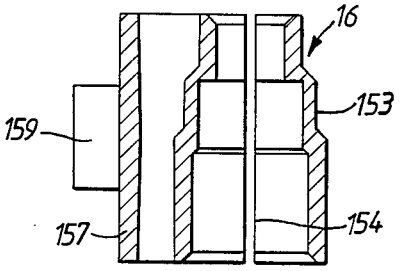

As has been referred to above, tank 2 is retained in position in the housing i by a releasable catch 16 shown in more detail in FIGS. 42, 43 and 44.

The catch 16 has a tubular support 153 stepped externally and internally as shown and slotted longitudinally as at 154. The internal stepping enables the support 153 to be located over the correspondingly contoured surface of stub 39 on clam shell 19. Longitudinal slot 154 imparts a degree of flexibility to the support so that it can readily be placed in position. Joined by arms 155 and 156 to the support 153 is a wall 157 cranked at 158 to lie in the lower part of the cut-aways 41 in clam shells 18 and 19. The wall 157 has small projections 159 located centrally of the width of the wall and with a beveled face 160 on the lower (as seen in FIG. 42) surface. An extension 161 of wall 157 is connected thereto by a limb 162 and has a hooked end 163. About midway along its length the limb 161 has a serrated surface 164.

Figure 45:
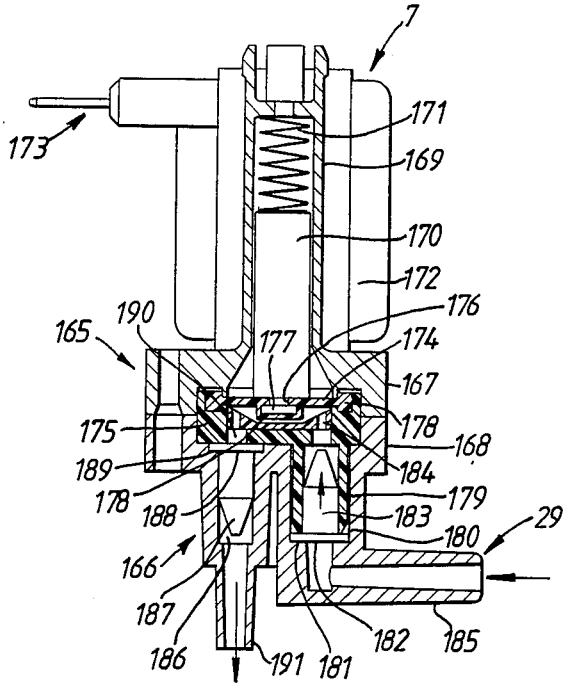

FIG. 45 shows the pump 7 in more detail. The pump has two principal body parts 165 and 166 each with cylindrical end portions 167, 168 respectively. Body part 165 has a central tubular extension 169 that houses a cylindrical core 170 of soft iron biased by a coiled spring 171 in a downwardly direction as viewed in FIG. 45. Surrounding the extension 169 and supported by the end portion 167 is a coil shown diagrammatically as block 172. The two ends of the coil are joined to respective electrical connectors one of which is shown at 173.

The adjacent faces of the end portions 167, 168 have central recesses of similar size and which house, respectively, a flexible diaphragm 174 and a cup shaped fitment 175. The diaphragm has a central aperture 176 which allows a head 177 on the core 170 to be inserted into a space within a central extension 178 of the diaphragm 174 thereby securing the latter to the core. The diaphragm also has a peripheral wall 178 that seats in a corresponding annular recess in the upper edge of the cup shaped fitment 175. The fitment 175 has a tubular extension 179 that locates in a passageway 180 in body part 168. The passageway 180 is stepped as at 18 and seated upon the step is the collar 182 of a duck-bill valve 183. The duck-bill valve 183 extends upward (as viewed in FIG. 45) into the extension 179 and terminates just below a hole 184 through the base of the fitment 175. The duck-bill valve 183 is orientated to allow flow in an upward direction only as indicated by the arrow. Passageway 180 extends through a lateral extension 185 of the body part 166 and forms the pump inlet 29.

Body part 166 has a second passageway 186 as shown and this accommodates a second duck bill valve 187 with a flange 188 at one end, the flange being seated upon a recessed shoulder 189 at the upper end of passageway 186. Passageway 186 terminates in a hole 190 through the base of the fitment 175. Duck-bill valve 187 is orientated to allow flow in a downward direction only as indicated by the arrow. Passageway 186 terminates in a downwardly extending nozzle 191 which forms the pump outlet.

During manufacture and prior to placing the components in the housing, it is necessary first to assemble the steam generator. The thermally responsive device 92 is placed in the recess 91. Cover plate 92 is placed in position on the body 85 so that studs 192 extending from the upper face of the body pass through corresponding holes in the cover plate and hole 93 register with device 91.

The tops of the studs 192 are then peened over to secure the cover plate 92 to the body 85. Two of the studs 192 are so located that they pass through holes in the metal strap 112 so securing the latter and thus the thermally responsive device 92 in position. The conductors 13 and 114 are then electrically secured to the terminals of the device 92 and positioned as shown in FIG. 23. Conductor 113 is electrically joined to terminal 116 by a suitable jointing tag.

Finally, the flexible connector 30 (FIG. 4) is attached to the cover plate 92 by locating the edge surrounding the hole 94 in a channel 194 in the head 195 of the connector. The connector 30 is joined to the pump outlet 191 as will be described below.

To assemble the components described above in the housing 1, the rocker arm 9 is located in the cut away 35 in clam shell 18, the bosses 134 being positioned in the semi-circular recess 34. The inclined surfaces 130 of the rocker arm 9 are accessible to a user through the cut away 35, and pivotal movement is limited by the flanges 132 which locate within the clam shells.

The switch 8 is then seated in the recessed portion 33A of the rib 33 with the switch terminals pointing towards the cable outlet 42 and the rocker 127 lying in the path of the extension 135 of the rocker arm 9.

The pump 7 is located in the compartment above the rib 37 with the nozzle 191 pointing downward (as viewed in FIG. 4) and the outlet 29 extending through the adjacent wall of the clam shell 18 via recess 47. In this orientation, the electrical connectors 173 are positioned just below the horizontal part of rib 33.

Tank catch 16 is secured in place by inserting the tubular support 153 over the bearing stub 39 so that the serrated surface 164 is accessible through cut away 41 and the hooked end 163 engages the nose of the clam shell 18 adjacent the cut away, i.e. the catch 16 is in the position shown in FIG. 4.

The assembled steam generator 3 is then mounted upon the base portion 4. With the base portion in the position shown in FIG. 13, a gasket seal/connector 118 is placed over each of nozzles 70 and 76, the interconnections 120 being pressed over the nozzles 70 and 76, and the gasket portion 121 seating on the boss 68. The steam generator 7 is then placed in position with the ears 86 seated upon the bosses 68. In so doing, the nozzles 111 of the steam generator engage into the interconnections 20. Screws are then entered through the ears 86 and screwed into the bores in the bosses 68 to secure the steam generator to the base portion 4.

The base portion is then engaged with clam shell 18, the stepped edge 65 engaging with the correspondingly stepped edge 46 of the clam shell. These parts are secured together by screws passed upwardly through the bores of two of the bosses 24 and screwed into the bores of bosses 49 in he clam shell.

After the base portion 4 has been secured to clam shell 18, the connector 30 (FIG. 4) is pushed on to the outlet nozzle 191 of the pump 7.

A neon indicator lamp 197 is located in the recesses 57 in the clam shells 18, 19 and electrical connections are completed between the terminals of the switch 8, terminals of the neon lamp 197, the terminals 88 of the heating element 87 and the conductors of the power lead 198 (FIGS. 3 and 4) so that when the latter is connected to a power source, element 87 is energised and the neon lamp lights to indicate energisation, and so that movement to its 'ON' position of the rocker 9 operates switch 8 to its 'ON' position and the coil of the pump is energised.

Connected in series with the power supply to the pump is a half wave rectifier, for example a diode (not shown).

The second clam shell 19 is then placed in position on clam shell 18 and the base portion 4 and secured in place by screws passed upwardly through the bores in the remaining two bosses 74 in the base portion, and other screws passed through apertures 59A in clam shell 19 and into bores in bosses 59 in the other clam shell 18.

The water tank 2 is now assembled by securing the filter 147 in the recess 146 of fitment 144 and the latter is attached to the water outlet tube 28. The fitment 144 and the tube 28 are inserted through hole 150 in the rear wall 25 of the water tank 2 and connector 27 is pressed firmly into the hole.

The inset top and rear wall 21, 25 of the water tank 2 allow the edges of the front wall 148 and side 15 walls 149 to locate closely adjacent to the flanges 32B and those edges to blend with the bevels 32A can be seen, for example, in FIG. 1.

To use the appliance, tank 2 is filled with water via the hole 22 in the upper wall 21 of the tank 2 and the hole closed by the removable stopper 23. The tank 2 is next placed in position on the housing, care being taken to ensure that the projecting extension 29 of the pump 7 passes through the lip 142 and into the connector.

As the tank 2 is placed in position, the upper wall 21 of the tank comes into contact with the bevelled face 160 of the projection 159 and displaces it by flexing the lower part (as viewed in FIG. 42) of the wall 157.

As the tank reaches its final position, projection 159 snaps into recess 24 to hold the tank 2 in position in the housing 1.

The power lead is then connected to a source of power and the neon lamp glows indicating that element 87 is energised. The user allows a short time for the steam generator to reach a working temperature and then rocker arm 9 is actuated to its 'ON' position so operating switch 8 and energising the pump. The rounded contour of the extension 135 facilitates operation of the rocker 127 of the switch 8 as the rocker arm 9 pivots on the bosses 134.

Energisation of coil 172 draws the core 170 upwardly as seen in FIG. 45, against the action of spring 171. Diaphragm 174 is flexed upwardly and draws in water from the tank 2 via filter 147, connector tube 28, inlet 185 and duck bill valve 183. Coil 172 is then de-energised and spring 171 forces the core 170 downwardly so flexing diaphragm 174 downwardly and expelling water through duck bill valve 187 and outlet 191. Energisation and de-energisation of the coil occur at about 25 cycles per second and this gives a continuous floor of water whilst the pump is operating.

Water is pumped via connector 30 into chamber 95 where it is flashed into steam by the heat of the body 85. The generated steam flows along passages 96 and 97 to intermediate areas 98, 99 and thence to the outlet nozzles 70 where it emerges into the steam chamber 6 and rapidly fills the latter.

The serpentine passages between the water chamber 95 and the nozzles 70 allow the steam to be dried so that by the time it exits from the nozzles, the moisture content is very low.

At this stage, the base portion is placed against an area of wallpaper to be stripped, the edge of the peripheral wall 62 being pressed against the wallpaper. Steam confined in the chamber permeates through the wallpaper and rapidly softens the adhesive holding the wallpaper in position. The steamer is then moved to an adjoining area of wallpaper while the user scrapes off the wallpaper covering the area.

It is not necessary to maintain the pump energised continuously, the user may return the rocker arm to its 'OFF' position during movement of the steamer from one area of wallpaper to another.

The water capacity of the tank 2 in conjunction with the rating of the heating element 85 and the pumping rate of pump 7 is such that the steamer can be used for about 20 minutes before the tank 2 needs refilling. The pumping rate is about 25 cc/min.

A water tank capacity of about 400 ccs in conjunction with a heating element rated at 1.2 kilowatts provides the time just referred to.

The mass of the steam generated in conjunction with a heater of the rating mentioned vaporises water feed into chamber 95 and heats the vapour to a temperature of 120° C. nominal measured in the chamber 6. Steam from the nozzles 70 enters the chamber at a pressure sufficiently high to ensure that the chamber 6 is quickly filled with steam and kept filled. This action is assisted by the recessed areas 82 and 83.

The parameters just referred to allow the steamer to be of a size and weight that can be conveniently hand-held and used without excessive strain on the user. In addition, for an average wallpaper, the time that the user takes to strip an area that has just been steam treated is about equal to the time that the steamer takes to soften the adhesive in that area. The rating of the heater also means that the steamer is suitable for use in domestic premises.

It will be appreciated that the bulk of the steam generator 3 is spaced from the floor 64 of the base portion 4. The ears 86 by which the generator is mounted upon the bosses 68 are thermally insulated by the parts 121 of the gasket seal/connector while the connectors 120 are interposed between the nozzles 111 of the steam generator and nozzles 70 and 76 in the floor 64 of the base portion. This ensures that the base portion which is accessible to a user always remains at a relatively low and safe temperature whilst it is in use.

The steamer is normally used with the water tank 2 uppermost and in that position, it will be observed, for example from FIG. 4, that the steam generator 3 is located towards the lower end of the steam chamber 6 and that is a greater distance between the upper side of the steam chamber and the upper of the nozzles 70 and 76 than between the lower edge of the steam chamber and the lower of the nozzles 70 and 76. This sifting of the generator relative to the steam chamber improves the distribution of steam in the chamber.

The steamer can also be used in the removal of paper from ceilings. In that case, the chamber 6 is uppermost. Any condensation that forms on wallpaper during the steaming of an area of wallpaper on a ceiling tends to fall into the steam chamber where it collects in the gutter 66. The condensation may be discharged from the gutter 66 by simply returning the steamer to an upright position and allowing the condensation to run away.

I claim:

1. A hand-held, wallpaper steamer for use in wallpaper stripping comprising a housing with a base open at one face to form a chamber with a peripheral wall which is placed against wallpaper to be stripped, the housing having, between its ends, a column extending away from the base, and a removable water tank, said column being contoured on one face to receive the water tank and on another face to form a handle that is spaced from the base and extends in a direction generally parallel thereto.

2. A steamer as claimed in claim 1 in which the one face is contoured to form a projection which extends over the water tank when in position and houses means for holding the water tank in position.

3. A steamer as claimed in claim 2 in which the water tank has walls transparent at least in part, and the steamer further comprises a water pump and a steam generator, a feed tube in the water tank being releasably connected to an inlet of the pump, and an outlet of the pump being connected to the steam generator, and the steam generator being connected with said steam chamber.

4. A steamer as claimed in claim 3 in which said water tank and said housing have upwardly and inwardly sloping side walls, said water tank also having an upwardly and inwardly sloping front wall, and air vents in said housing communicating with a space between said base and said steam generator.

5. A steamer as claimed in claim 2 in which a normally upper surface of the column that projects from the base is contoured to accommodate one or more controls for the steamer.

6. A steamer as claimed in claim 1 in which the handle forms, with the housing, a closed loop.

7. A steamer as claimed in claim 1 wherein said contoured one face of said column includes a portion spaced from said base and extending into overlying relationship with respect to said water tank.

8. A steamer as claimed in claim 7 further including releasable latch means operable to releasably retain said water tank on said housing.

9. A steamer as claimed in claim 8 wherein said latch means is disposed within said overlying portion of said housing.

10. A steamer as claimed in claim 1 wherein said one face and said another face are on opposite lateral sides of said column.

11. A steamer as claimed in claim 1 wherein said water tank includes sidewalls positioned adjacent lateral sidewalls defining said column and contoured to generally conform to the contour of said lateral sidewalls.

12. A steamer as claimed in claim 11 wherein said sidewalls include recessed portions therein, said recessed portions being operative to facilitate grasping of said water tank for removal thereof.

13. A steamer as claimed in claim 1 further comprising switch means positioned at the end of said column remote from said base.

14. A steamer as claimed in claim 1 wherein said housing further includes a second column extending upwardly from the base and merging with said handle at an end thereof remote form said column.

15. A hand-held, wallpaper steamer for use in stripping wallpaper comprising a housing of two-part clam shell construction, a base portion open to one face to form a steam chamber with a peripheral wall which is placed against wallpaper to be stripped, the clam shells also being contoured to receive the base portion and to form a handle spaced from the base and extending in a direction generally parallel to the base portion.

16. A steamer as claimed in claim 15 in which the base portion includes a floor that separates the chamber from the interior of the housing.

17. A steamer as claimed in claim 15 wherein said clam shells are contoured to provide a peripheral stepped shoulder, said stepped shoulder receiving said base portion.

18. A steamer as claimed in claim 17 wherein said base portion includes an upwardly projecting flange received by said stepped shoulder portion.

19. A steamer as claimed in claim 18 wherein said stepped shoulder telescopically receives said upwardly projecting flange.

20. A steamer as claimed in claim 15 further comprising a plurality of fastener means extending between said clam shells, said fastener means being operative to retain said clam shells in assembled relationship.

21. A steamer as claimed in claim 20 further comprising fastener means extending between said base portion and said claim shells to secure said base portion to said clam shells.

22. A hand-held wallpaper steamer comprising a housing of two-part claim shell construction open at one end, a base portion with a floor and a peripheral wall to form a chamber open at one face, the clam shells being contoured to receive the base portion at the open end of the housing to close that end, the clam shells also being contoured to form a handle spaced from the base portion and extending in a direction generally parallel thereto, a steam generator located in the housing and having a series of spaced steam outlets, the said floor having a lower surface that faces into said chamber, and said floor having an upper surface that faces inwardly of the housing and which carries a series of spaced apertured bosses that provide communication from the steam outlets into the chamber.

23. A hand-held, wallpaper steamer for use in stripping wallpaper comprising a housing of two-part clam shell construction, a base portion having a floor and being open at one face to form a steam chamber with a peripheral wall which is placed against wallpaper to be stripped, said floor separating said chamber from the interior of the housing, said floor having a channel formed at a junction of the floor with the peripheral wall.

24. A steamer as claimed in claim 23 in which the floor has one surface that faces inwardly of the housing, and said one surface having a series of spaced, mounting studs, and a steam generator mounted upon the mounting studs.

25. A steamer as claimed in claim 24 in which said one surface of the floor also has a series of apertured bosses which provide communication from steam outlets of the generator to the chamber.

26. A steamer as claimed in claim 25 in which the clam shells together form a hollow column extending away from the open end of the housing, and in which the column is shaped internally to receive a water pump for pumping water to the steam generator.

27. A hand-held wallpaper steamer comprising a housing of two-part construction and providing a base portion forming a steam chamber with a depending peripheral wall and an open face which is placed against wallpaper to be stripped, a water tank accommodated in the housing in a manner permitting removal of the tank from the housing, the housing being adapted internally to support an electrically heated steam generator with steam exits and an electric water pump for supplying water from the tank to the steam generator, the steam exits communicating with the steam chamber.

28. A hand-held wallpaper steamer for use in stripping wallpaper, said steamer comprising:

a hollow housing;

a base portion secured to said housing, said base portion and said housing together defining a substantially enclosed area and said base portion including a peripheral wall defining an outwardly facing open face steam chamber;

a water tank removably attached to said housing;

an electric pump disposed within said housing and having an inlet extending into said water tank and said water tank is assembled to said housing and an outlet;

an electrically heated steam generator having a plurality of spaced steam exits secured to an inwardly facing surface of said base portion, said outlet of said pump being connected to an inlet of said steam generator;

insulating means disposed between said base portion and said steam generator to space said steam generator from said inwardly facing surface of said base portion;

said base portion having a plurality of spaced openings therein, one of said openings communicating with each of said steam exits to conduct steam from said steam generator to said steam chamber.

29. A steamer as claimed in claim 28 wherein said insulating means further includes means for placing each of said steam exits in sealed fluid communication with respective of said openings in said base portion.

30. A steamer as claimed in claim 28 further comprising switch means in said housing for selectively energizing said electric pump.

31. A steamer as claimed in claim 28 wherein said hollow housing includes a column extending away from said base portion, said electric pump being disposed within said column.

32. A steamer as claimed in claim 31 wherein said column has a first portion extending laterally outwardly from one side of an upper end thereof in generally spaced parallel relationship to said base, said first portion defining a handle.

33. A steamer as claimed in claim 32 wherein said housing includes a second column extending upwardly away from said base portion and merging smoothly with said handle at an end thereof remote from said column.

34. A steamer as claimed in claim 32 wherein said column includes a second portion extending laterally outwardly from another side of said column in generally spaced relationship to said base portion, said second portion defining a space for receiving said water tank.

35. A steamer as claimed in claim 34 further comprising latch means carried by said second portion for releasably retaining said water tank in assembled relationship with said housing.

36. A steamer as claimed is claim 28 wherein said housing comprises two clam shell sections secured together, said clam shell sections having substantially mirror image contours.

37. A steamer as claimed in claim 36 wherein said claim shell sections include a peripheral stepped shoulder for receiving and positioning said base portion with respect thereto.

38. A steamer as claimed in claim 37 wherein said base portion includes an outwardly projecting flange adapted to be telescopically received by said stepped shoulder portion.

* * * * *